US010485326B2

(12) United States Patent
Williamson et al.

(10) Patent No.: US 10,485,326 B2
(45) Date of Patent: Nov. 26, 2019

(54) SYSTEMS AND METHODS FOR INCREASING SITUATIONAL AWARENESS, ERGONOMIC, AND COGNITIVE FUNCTION(S) FOR AN OPERATOR CARRYING, INTEGRATING, AND USING A COMBINATION OF EQUIPMENT ITEMS IN A VARIETY OF OPERATING ENVIRONMENTS AND MISSIONS INCLUDING A WEARABLE PORTABLE ELECTRONIC DEVICE WITH DISPLAY AND HANDS-FREE BODY MOUNTED DEVICE HOLDER

(71) Applicant: The United States of America as represented by the Secretary of the Navy, Washington, DC (US)

(72) Inventors: Christopher Williamson, Bloomfield, IN (US); Lawrence Shirley, II, Bloomfield, IN (US); Ross Severn, Windsor, CO (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 15/801,263

(22) Filed: Nov. 1, 2017

(65) Prior Publication Data

US 2018/0140078 A1 May 24, 2018

Related U.S. Application Data

(60) Provisional application No. 62/425,891, filed on Nov. 23, 2016.

(51) Int. Cl.
*A45F 5/02* (2006.01)
*A41D 1/04* (2006.01)
(Continued)

(52) U.S. Cl.
CPC ..... *A45F 5/02* (2013.01); *A41D 1/002* (2013.01); *A41D 1/04* (2013.01); *A41D 13/0012* (2013.01);
(Continued)

(58) Field of Classification Search
CPC ..... A45F 5/02; A45F 2200/0525; A45F 2003/146; A41D 1/04; A41D 2400/48;
(Continued)

(56) References Cited

U.S. PATENT DOCUMENTS 6,529,372 B1 * 3/2003 Ng ..... G06F 1/163 312/223.2
7,099,710 B1 * 8/2006 Faillance ..... A45F 5/00 455/575.1

(Continued)

*Primary Examiner* — Nathan J Newhouse
*Assistant Examiner* — Matthew T Theis
(74) *Attorney, Agent, or Firm* — Christopher A. Monsey

(57) ABSTRACT

Various systems and methods are provided for increasing situational awareness of an operator carrying, integrating, and using a combination of equipment items in a variety of operating environments in a compact configuration enabling rapid viewing and access or stowage with minimized eye and hand movement. In particular, embodiments include apparatuses and methods associated with a ruggedized hands-free body mounted portable display device holder. In particular, various embodiments are provided which enable an operator to use a combination equipment together in a body mounted system which increase situational awareness and ability to operate using a variety of body mounted equipment as well as carried equipment that reduce mass or streamline the operator's equipment loadout that is carried on their body e.g., body armor with equipment mounting loops or sewn strips.

1 Claim, 16 Drawing Sheets

(51) Int. Cl.
*A41D 13/00* (2006.01)
*A41D 1/00* (2018.01)
*A45F 3/14* (2006.01)

(52) U.S. Cl.
CPC ..... *A41D 2400/48* (2013.01); *A41D 2600/20* (2013.01); *A45F 2003/146* (2013.01); *A45F 2200/0525* (2013.01)

(58) Field of Classification Search
CPC ..... A41D 1/002; A41D 13/0012; A41D 2600/20; G06F 1/1628; G06F 1/163; G06F 1/1613; G06F 1/1615; H04B 2001/3855; H04B 1/385; H05K 5/0217; H05K 5/0017; H05K 5/0247; H05K 5/06
USPC ..... 224/624, 623, 675, 930
See application file for complete search history.

(56) References Cited

U.S. PATENT DOCUMENTS 8,607,363 B2 * 12/2013 Klann ..... G06F 1/163 2/115
9,306,612 B2 * 4/2016 Forsythe ..... H04B 1/3888
9,923,590 B1 * 3/2018 Picking ..... H04B 1/385
2007/0164987 A1 * 7/2007 Graham ..... A45F 5/00 345/156
2011/0009164 A1 * 1/2011 Amiri ..... G06F 1/1615 455/556.2
2013/0258573 A1 * 10/2013 Muday ..... G06F 1/1613 361/679.21
2015/0076183 A1 * 3/2015 Palma ..... A45F 5/004 224/162
2017/0068270 A1 * 3/2017 Kielland ..... A45F 5/00

* cited by examiner

SYSTEMS AND METHODS FOR INCREASING SITUATIONAL AWARENESS, ERGONOMIC, AND COGNITIVE FUNCTION(S) FOR AN OPERATOR CARRYING, INTEGRATING, AND USING A COMBINATION OF EQUIPMENT ITEMS IN A VARIETY OF OPERATING ENVIRONMENTS AND MISSIONS INCLUDING A WEARABLE PORTABLE ELECTRONIC DEVICE WITH DISPLAY AND HANDS-FREE BODY MOUNTED DEVICE HOLDER

CROSS-REFERENCE TO RELATED APPLICATIONS

The present application claims priority to U.S. Provisional Patent Application Ser. No. 62/425,891, filed Nov. 23, 2016, entitled "Systems and Methods for Increasing Situational Awareness of an Operator Carrying, Integrating, and Using a Combination of Equipment Items in a Variety of Operating Environments in a Compact Configuration Enabling Rapid Access or Stowage including A Ruggedized Hands-Free Body Mounted Portable Display Device Holder," the disclosure of which is expressly incorporated herein by reference.

STATEMENT REGARDING FEDERALLY SPONSORED RESEARCH OR DEVELOPMENT

The invention described herein includes contributions by one or more employees of the Department of the Navy made in performance of official duties and may be manufactured, used and licensed by or for the United States Government for any governmental purpose without payment of any royalties thereon. This invention (Navy Case 200,389) is assigned to the United States Government and is available for licensing for commercial purposes. Licensing and technical inquiries may be directed to the Technology Transfer Office, Naval Surface Warfare Center Crane, email: Cran_CTO@navy.mil.

BACKGROUND AND SUMMARY OF THE INVENTION

The present invention relates to systems and methods for increasing situational awareness of an operator carrying, integrating, wearing, and using a combination of equipment items in a variety of operating environments with ergonomically compatible and compact configurations enabling rapid access, viewing, interaction, or stowage with a minimum of movement and within a field of view and hand/equipment positioning or use associated with use of one or more of the equipment items. Embodiments can include apparatuses and methods associated with a ruggedized hands-free body mounted portable display device holder.

Exemplary systems and methods for increasing operator situational awareness can include components and relationships between components associated with carrying, integrating, and using equipment items in a variety of operating environments and missions including a wearable portable electronic device with display and a hands-free body mounted device holder having one or more ruggedized and compact form factor configurations enabling rapid access, manipulation, interaction, viewing, and stowage within one or more field(s) of view(s). The exemplary holder and mounting, orienting, and operational/movement relationship(s) with other equipment items enable ergonomically and cognitive/view interaction compatible holding, positioning, operating and/or wear of electronic device with a way that is compatible other equipment items.

In particular, various embodiments are provided which enable an operator to use a combination equipment together in a body mounted system which increase situational awareness and ability to operate using a variety of body mounted equipment as well as carried equipment that reduce mass or streamline the operator's equipment loadout that is carried on their body, e.g., body armor with equipment mounting loops or sewn strips.

Previous methods or apparatuses for carrying electronic devices such as tablet computers, portable computers with a display, etc. was in a pocket, pouch, or ruck sack. This made the use of the device very inaccessible during movement with equipment such as hiking, combat operations, first responder activities such as firefighting activities, etc. Lack of ability to rapidly access and store such electronic devices creates significant disadvantages for personnel attempting to use them while maintaining situational awareness.

Embodiments of the invention can include a tactical hands free electronic device holder. One purpose of various embodiments is to provide an operator with an ability to access tactical applications such as maps, global positioning system (GPS) systems, critical data while maintaining positive control of their equipment during an operation or movement. Embodiments of this invention are capable of being coupled with a wide variety of systems or body related supporting structures. Another advantage is that it can be fabricated with tools and equipment which is found in a field setting such as in remote areas and fabricated from field manufacturable or adjustable materials such as thermoplastics such as KYDEX®, which allows for manufacturing to fit or support a variety of electronic devices to be molded or fitted into the holder. Field manufacturability was also a key feature of various embodiments. Exemplary embodiments of this invention were designed, manufactured, tested, and adjusted/redesigned entirely in the field (e.g., Afghanistan). Thus, some aspects of utility in various embodiments come from ability to design, manufacture, and field test at a forward deployed or point of use location far from conventional manufacturing capabilities. Forward manufacturing is now an imperative given attacks on logistics chains are now a certainty in high intensity warfare. Similarly in austere locations, e.g., Mars or space, ability to manufacture without access to traditional supply chains is a critical requirement.

Embodiments of this disclosure were also designed with individual ergonomics in mind. For example, embodiments of this disclosure can attach directly to soldier's body armor at chest level. At some soldier carries an electronic device such as a smartphone or tablet in a pocket or bag. Ergonomically, this is a very inefficient way to carry an electronic device with tactically pertinent data into combat. An operator or soldier is required to take cover or be covered while trying to manipulate the electronic device while losing ability to fire at targets.

In particular examples, U.S. Special Forces operators requested an ability to carry a tablet on their kit that was readily accessible, easy to use, and allowed for hands free operation which was compatible with their movements, body postures, and uses of equipment (e.g., is positioned for use or rapid availability while carrying weapons and gear including body armor, helmet, etc. Special Forces Teams have a need for an ability to access critical data such as, GPS, Mapping, Targeting and other types of data. It is crucial that they have the ability to maintain situational awareness and positive control of their weapon, including ability to reduce eye movement from a field of view associated with aiming a rifle or minimizing eye and hand path movement, during combat missions, while accessing this information.

According to an illustrative embodiment of the present disclosure, a body mounted ruggedized portable display device holder attaches to a centered (left to right) portion of body armor above magazine holders to allow for hands free viewing while being able to withdraw magazines from the magazine holders. When not in use, exemplary holder folds out of the way of the magazine holders or pouches or other user equipment carried on the user's body or by the user or in proximity to a user when in stowed position holder protects the tablet screen. An exemplary hinge made from ¼" all thread to provide sturdy reliable operation.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Figure 1B:
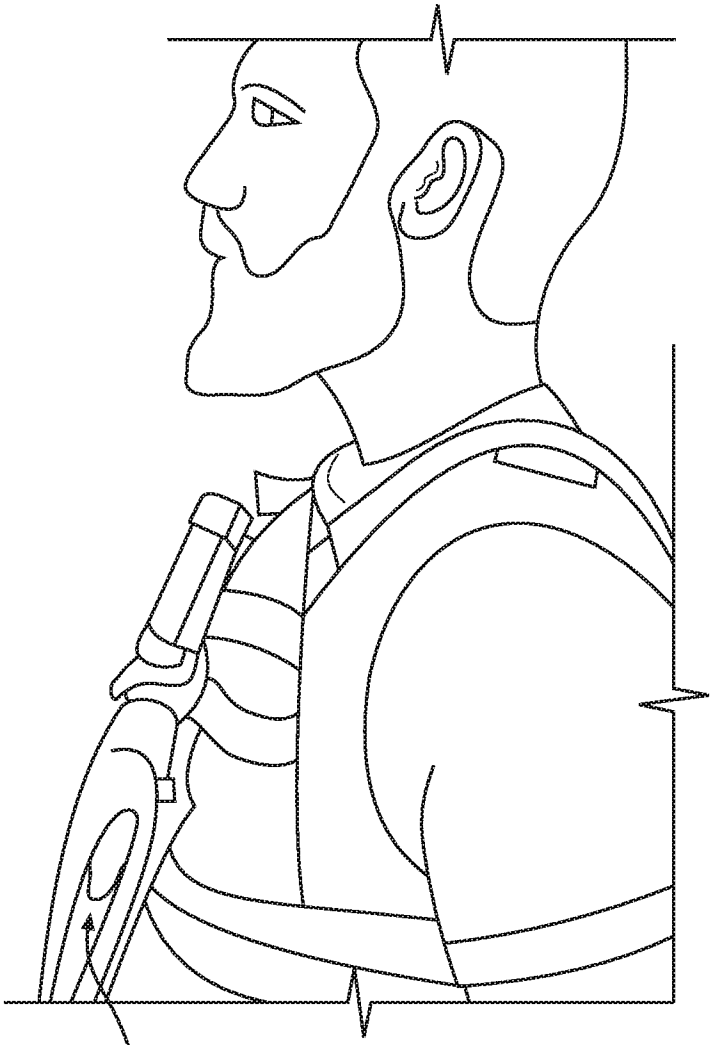
FIG. 1B shows an operator with the exemplary body mounted ruggedized portable display device holder in a closed position.
Figure 1A:
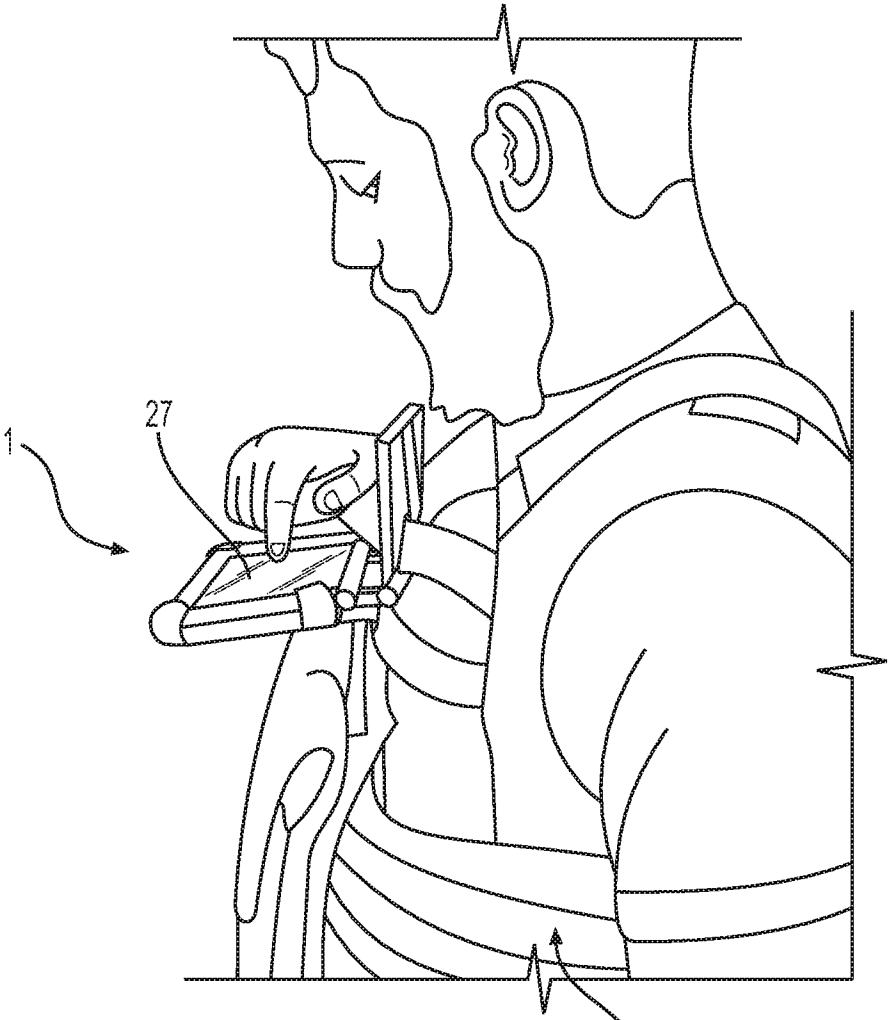
FIG. 1A shows an operator or human with an exemplary body mounted ruggedized portable display device holder in an open and in-use position with an installed exemplary display device such as a tablet computer or smartphone.

Referring initially to FIG. 1A, an exemplary body mounted ruggedized portable display device holder 1 in an operational position with an installed exemplary display device 27. Installed exemplary display device 27 may be a tablet computer a smartphone, global positioning system (GPS) device, or any other similar device proportioned for portable use. The body mounted ruggedized portable display device holder 1 may be attached to the front side of body armor 14 worn by the operator. In other embodiments, the portable display device holder 1 may be attached to any other article of clothing worn by the user (e.g., safety equipment, a uniform, a medical brace). In some embodiments, the portable display device holder 1 on the chest of the operator, or adjustable to any other height, such that the operator may have a direct line of sight with display device 27.

FIG. 1B shows an operator or human with an exemplary body mounted ruggedized portable display device holder 1 in a stowed position. While the portable display device holder 1 is in a stowed position, the display device 27 may lay flat against the operator's chest. The portable device holder 1 may be manufactured using a thermoplastic material, such as an acrylic, polyvinyl chloride, or combination of the two. For example, Kydex® may be used as the thermoplastic material in some embodiments. The thermoplastic material may be sufficiently tough to withstand impacts generated by normal field use (e.g., dropping to the ground, crawling along the ground, and regular everyday use). In other words, the modulus of elasticity of the thermoplastic material may fall in a range from 250,000 to 500,000 psi. The thermoplastic material may also be relatively hard to prevent scratches in normal field use. The thermoplastic material may be easily manufactured, such that the portable display device holder 1 can be manufactured at the point of use, without the access to large-scale manufacturing machining equipment. The thermoplastic material may be manufactured into the portable display device holder 1 by thermoforming, post-forming, brake-forming, lamination or any combination thereof. In some embodiments, any other thermoplastic material suited for thermoforming fabrication may be used. Thermoplastic may be substantially elastic after manufacturing such that it may be manipulated to change its shape when sufficient force is applied to it by the operator. The portable display device holder 1 may be manufactured to fit with a specific display device 27 requested by the operator.

Figure 2:
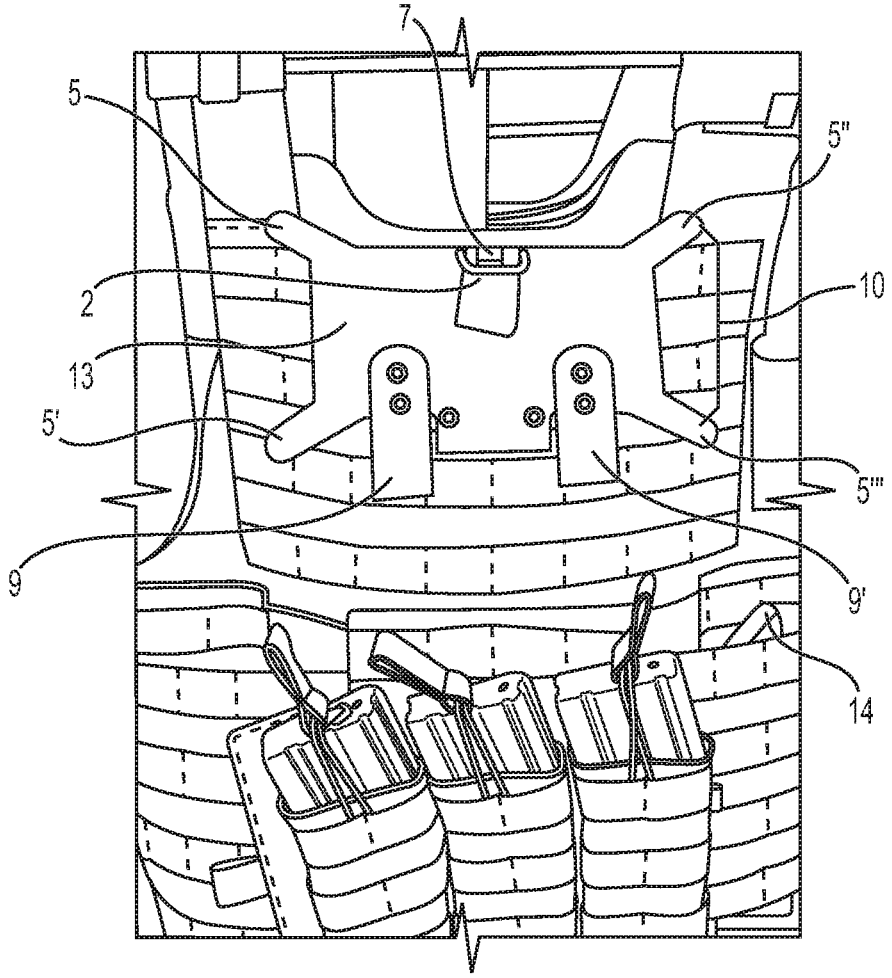
FIG. 2 shows a front view of an exemplary equipment mounting vest or body armor with exemplary body mounted ruggedized portable display device holder in a closed position.

FIG. 2 shows a front view of an exemplary equipment mounting vest or body armor 14 with exemplary body mounted ruggedized portable display device holder 1 in a closed position. The body mounted ruggedized portable display device holder 1 may include a first support section 10 that has different sections including a device backing plate section 13 and device clasp sections (5, 5', 5", 5"). Exemplary first support section 10 is cut and shaped from, e.g., a thermoplastic sheet material (e.g, Kydex®) that is cut or formed to have the device clasp sections (5, 5', 5", 5") (e.g., planar rectangular sections diagonally extending away from each corner portion of the first support section 10 with rounded ends). This figure shows the device clasp sections (5, 5', 5", 5") in a un-thermally manipulated or folded over configuration before the display device 27 has been coupled with the first support section 10. The first support section 10 may be disposed, such that, when the display device 27 is inserted in the body mounted ruggedized portable display device holder 1 with the device clasp sections (5, 5', 5", 5") are bent over the display device 27 such that the display device 27 is mechanically and rotatably coupled with wearable article such as, e.g., body armor 14, using the device holder 1. First support section 10 may include a device backing plate section 13 and a plurality of device clasp sections (5, 5', 5", 5") that protrude away from device backing plate section 13. Device backing plate section 13 may be a rectangular shape such that a perimeter of the device backing plate section 13 is substantially similar or conforms to that of a display device (27, not shown). In other embodiments, the perimeter of device backing plate section 13 may be smaller than the display device (e.g., 27) such that the display device encompasses the device backing plate section 13. The plurality of device clasp sections (5, 5', 5", 5") may extend from device backing plate section 13 so that the device clasp sections (5, 5', 5", 5") extend past perimeter of display device (e.g., 27). FIG. 2 shows an exemplary embodiment of body mounted ruggedized portable display device holder 1 with four device clasp sections (5, 5', 5", 5") protruding from corners of device backing plate section 13. In at least some embodiments, a second support section 15 may be rotatably coupled to the first support section 10 so that rotation is arrested via a plurality of mechanical stops 9, 9'. Alternatively, mechanical stops 9, 9' can alternatively include bendable material (not requiring heating) such as a metal structure (not shown) which can be manually manipulated or bent to adjust rotation of the first support section 10.

The device backing plate section 13 may include a notch 7 at a top edge of the device backing plate section 13. In some embodiments, the notch 7 may be formed by removing material at a center of the top edge of the device backing plate section 13. FIG. 2 shows an exemplary embodiment of a rectangular notch 7 formed at the center of the top edge of the device backing plate section 13. In other embodiments, notch 7 may form an acute trapezoidal outline, with the longer base of the trapezoid closer to the bottom edge of device backing plate section 13 and the shorter base being the cut-out section of the perimeter at the top edge of device backing plate section 13. The notch 7 receives and interacts with latch assembly 2 to prevent the first support section 10 from rotating in a direction away from the body armor 14 along an axis formed parallel to the bottom edge of first support section 10.

Figure 3B:
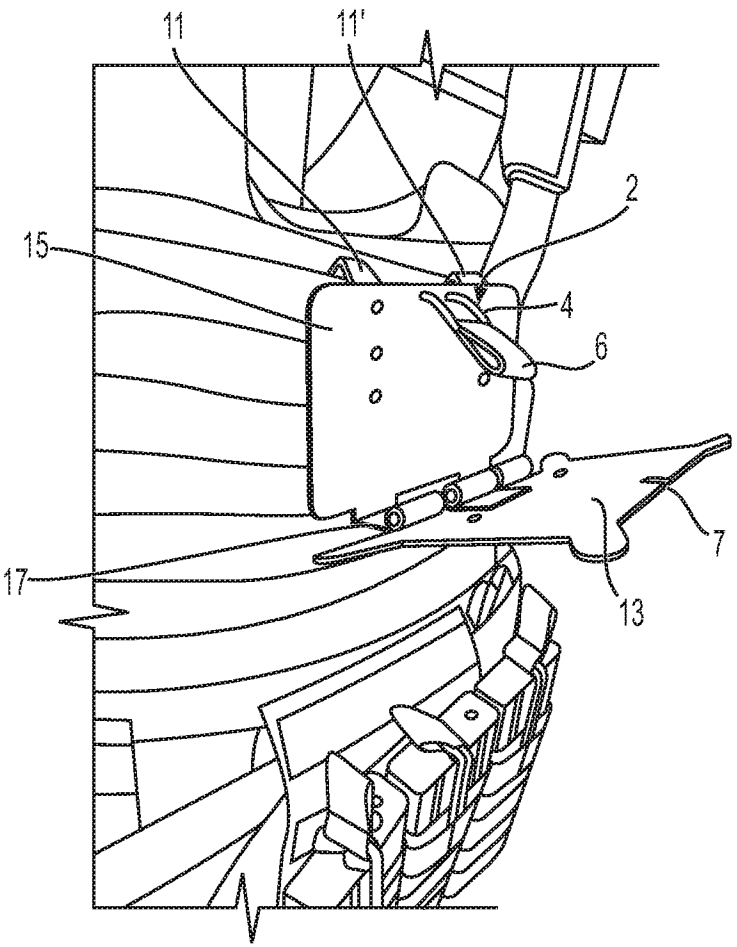
FIGS. 3A and 3B show angled side-front view of an exemplary equipment mounting vest or body armor with the exemplary body mounted ruggedized portable display device holder in an opened position without exemplary portable display device and clasp sections in a pre-device installation configuration.
Figure 3A:
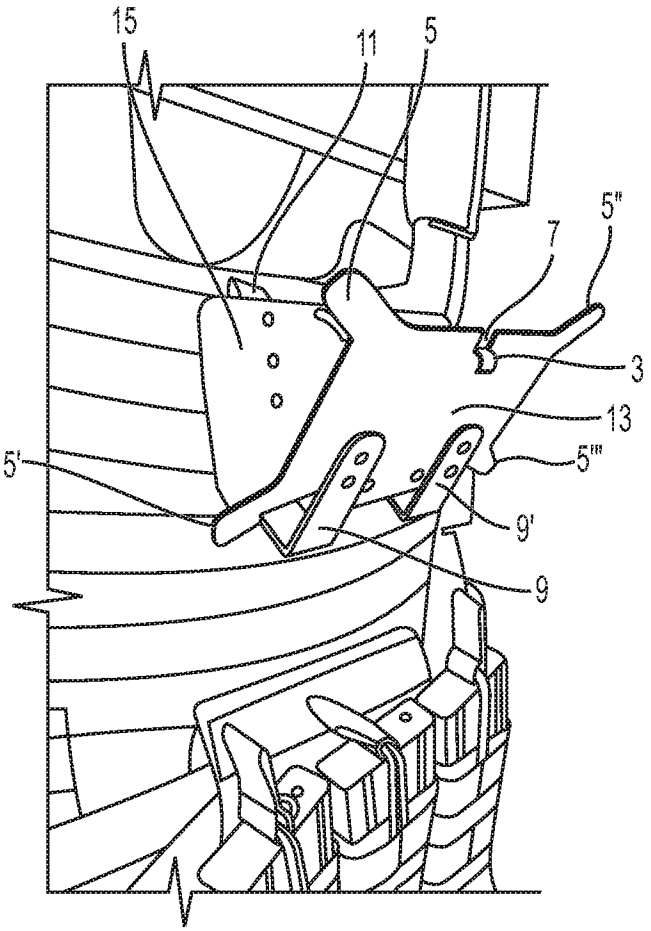

FIGS. 3A and 3B show angled side-front view of an exemplary equipment mounting vest or body armor 14 with exemplary body mounted ruggedized portable display device holder 1 in an opened position. Referring to FIG. 3A, a front side of the second support section 15 is shown and may be rectangularly shaped such that it is substantially the same size as display device 27. Second support section 15 may be larger in footprint or form factor than the display device 27; in other words, the perimeter of second support section 15 can be larger than or extend beyond at least some or all the edges or perimeter of display device 27. In an exemplary embodiment, second support section 15 is coupled to a plurality of structural clips 11, while in other embodiments only one structural clip 11 may be used. The structural clips 11 may be coupled to second support section 15 through any suitable means, including but not limited to, fasteners, snap fasteners, buttons, hook and loop fasteners, stitching, latch, buckle, strap, adhesive or other means of fastening. Mechanical stops 9, 9' may be coupled to the first support section 10 in the same manner as discussed above.

In some embodiments, a front side of the first support section 10 may include a coupling hook 3 which receives or couples with a latch assembly 2. The hook 3 may protrude from device backing plate section 13 at a location where notch 7 is extruded or bent away from device backing plate section 13. In some embodiments, hook 3 may be formed from the material that is displaced to make notch 7. Hook 3 may be configured to hold latch 2 (e.g., 4, 6) such that tension created by the elasticity of an elastic section 4 (see FIG. 3B) of latch assembly 2 that forces the latch assembly 2 in a direction towards second support section 15 thus preventing latch 2 assembly from slipping out of the hook 3.

Referring to FIG. 3B, latch 2 may include an elastic band 4 coupled to a tab 6, such that the elastic band 4 may be more easily manipulated by pulling on the tab 6. The elastic band 4 may be made of an elastic material such as, but not limited to, nylon, spandex, rubber, stretch vinyl (polyvinyl chloride), or any other suitable material. Alternative first and second support section latching or coupling structures (latch assembly 2/hook 3 rapid latching or coupling function equivalents) can also be used however they must have a structure(s) which enables rapid and easy gripping of the latch assembly 2 (e.g., in this example via a tab 6 which is coupled with elastic section 4) that can be manipulated by an operator including ones wearing gloves in a position that the device holder 1 is positioned in relative to operator hand positions in at least one equipment utilization configuration (e.g., equipment item (e.g. fire hose, sensor, etc) or weapon up, oriented forward, with hand positioned on trigger).

In at least one embodiment, a threaded rod 17 may be employed as a hinge on which first support section 10 may rotate relative to second support section 15 about a fixed axis at the bottom edge of second support section 15. In other embodiments, threaded rod 17 may be an 'all-thread' rod or alternatively may not include any threads at all. When latch 2 is not coupled to notch 7, the first support section 10 may be manipulated to rotate away from second support section 15. First support section 10 may be disposed such that the angle between second support section 15 and first support section 10 may be between 0° and 120°. First support section 10 may be configured such that a display device 27 may be disposed on a back side of device backing plate section 13 at a specified angle chosen by the operator so that operator may easily see a screen on display device 27. First support section 10 may be locked at a specified angle so that the weight of the phone will not change the angle between first support section 10 and second support section 15.

Figure 4:
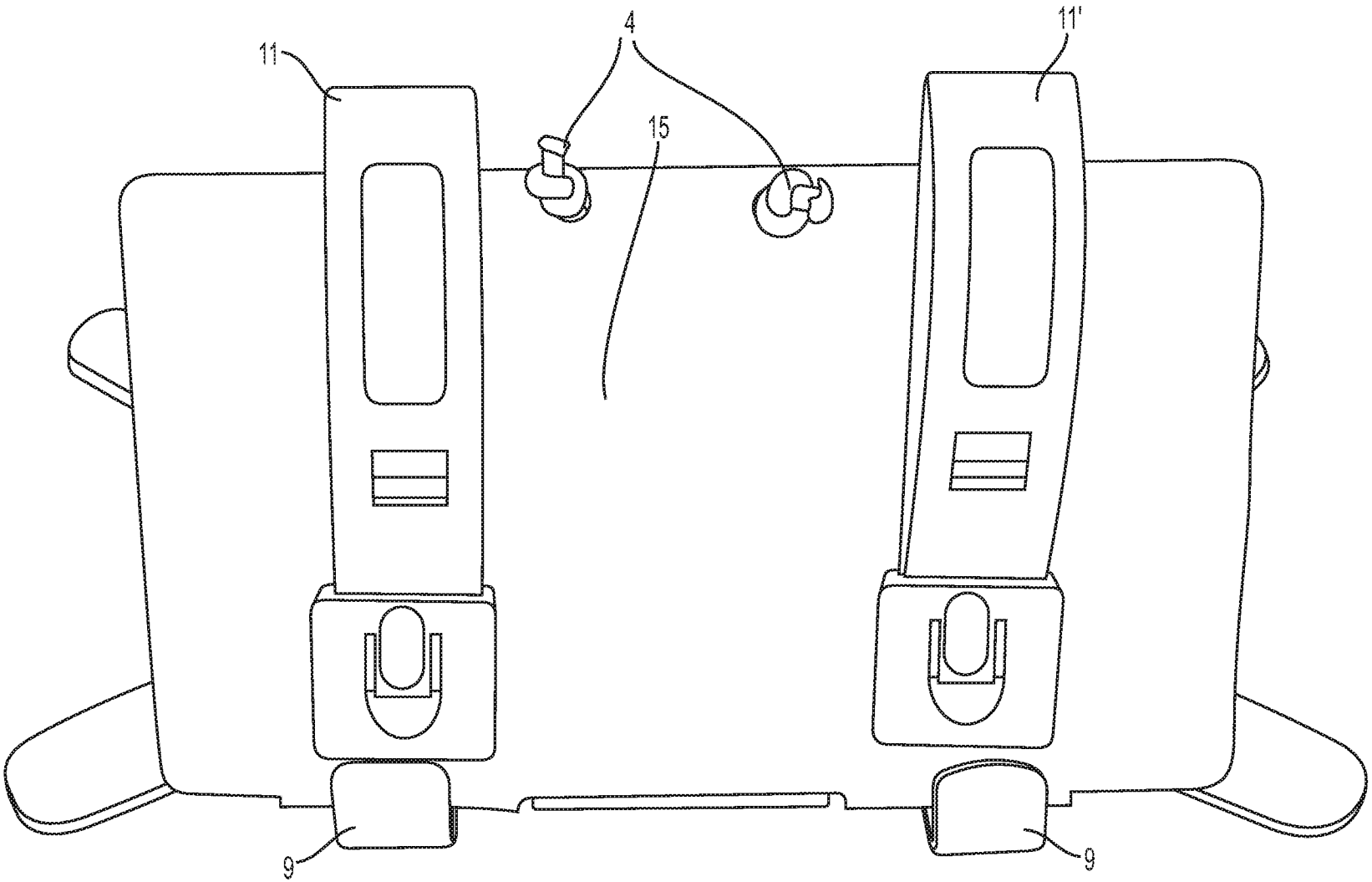
FIG. 4 shows a rear view of an exemplary body mounted ruggedized portable display device holder in an open position.

FIG. 4 shows a rear view of an exemplary body mounted ruggedized portable display device holder in an open position. A back side of second support section 15 is shown with attached structural clips 11. Structural clips 11 may be made of any flexible material including, but not limited to, rubber, plastic, vinyl or the like. In an exemplary embodiment, structural clips 11 may form loops, such that one end of one structural clip 11 is disposed adjacent to one other end of the one structural clip 11. In some embodiments, second support section 15 may include at least one hole near the top edge of the second support section 15. The elastic band 4 of the latch 2 protrudes through the at least one holes in second support section 15. In some embodiments, the elastic band 4 may be attached to the back side of second support section 15 in any suitable manner such as adhesive, fastener, stitching, or the like. In other embodiments, the elastic band 4 may be tied in a knot so that the knotted section of the elastic band 4 cannot pass through the one or more holes.

Mechanical stops 9, 9' may be coupled to the back side of the first support section 10 (or alternatively second 15). While some embodiments may include two mechanical stops 9, 9', other embodiments may include more than two mechanical stops. Referring to FIG. 4, one portion of the mechanical stops 9, 9' may be attached to the front side of the first support section 10 (see e.g., device backing portion 13, FIG. 5). The mechanical stops 9, 9' may be coupled to the support section 15 through any suitable means, including but not limited to, snap fasteners, buttons, hook and loop fasteners, stitching, latch, buckle, strap, adhesive or other means of fastening. (See FIG. 7 for more details).

Figure 5:
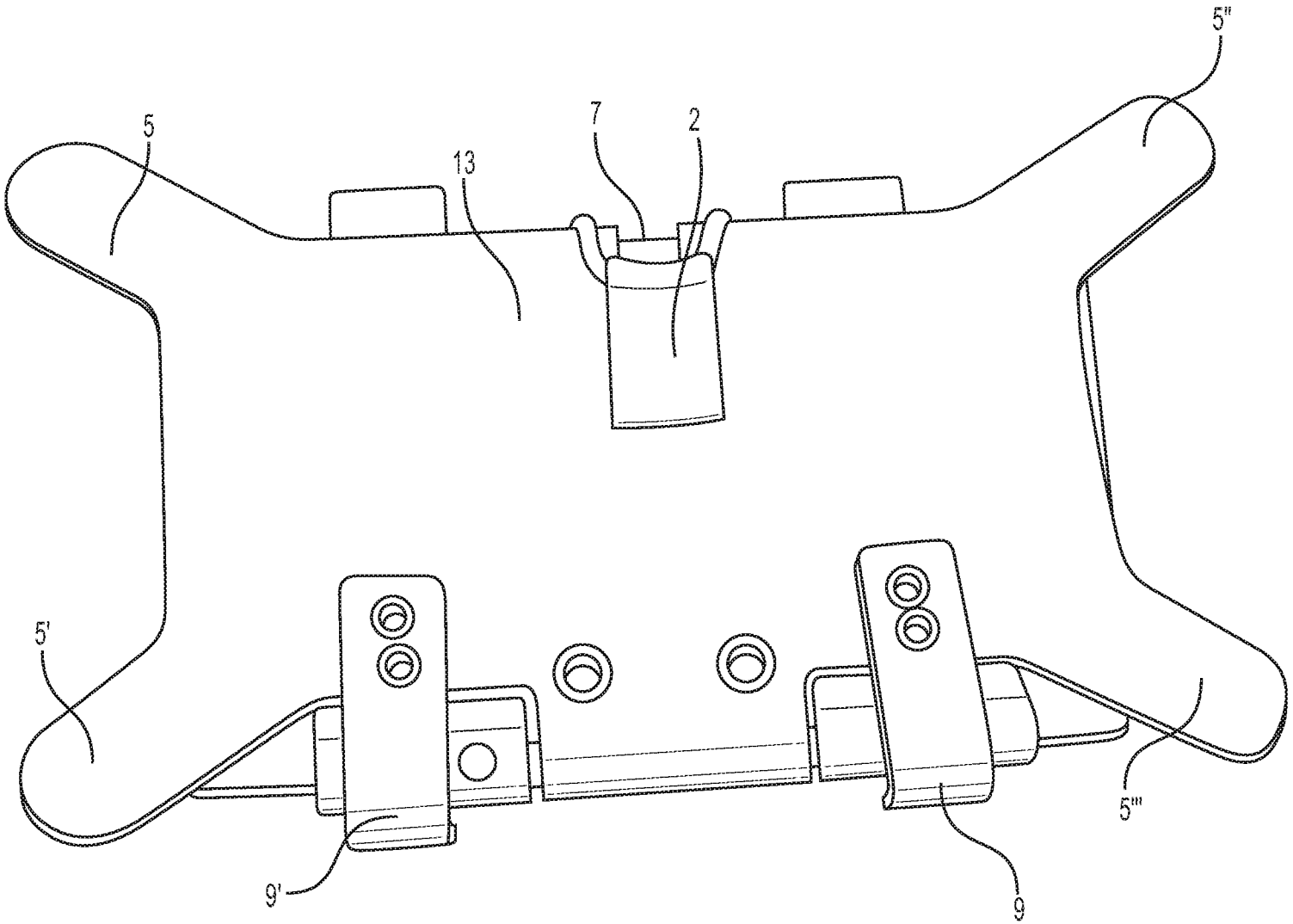
FIG. 5 shows a front view of an exemplary body mounted ruggedized portable display device holder in a closed position.

FIG. 5 shows the front side of first support section 10 of an exemplary body mounted ruggedized portable display device holder 1 in a closed position. The mechanical stops 9 may be coupled to first support section 10 through any suitable means, including but not limited to, snap fasteners, buttons, hook and loop fasteners, stitching, latch, buckle, strap, adhesive or other means of fastening. The FIG. 5 embodiment is shown with latch assembly 2 in an engaged position held by hook 3 (not visible) beneath notch 7.

Figure 6B:
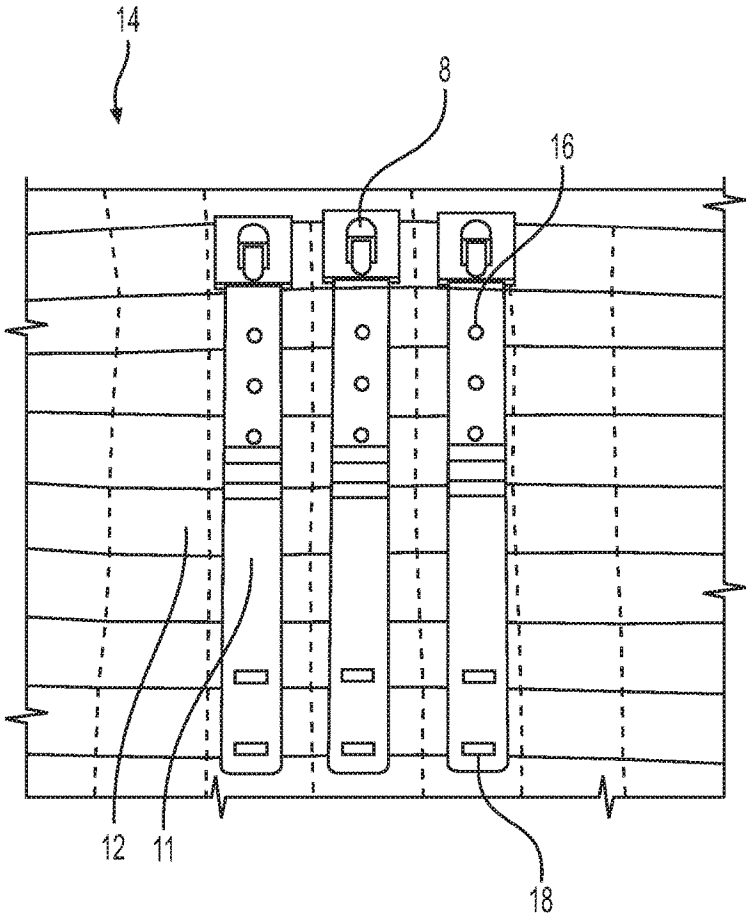
FIG. 6B shows exemplary clips or loop structures that are disposed or coupled on top of the mounting loops or webbing used with an exemplary body mounting system such as shown in FIG. 6A.
Figure 6A:
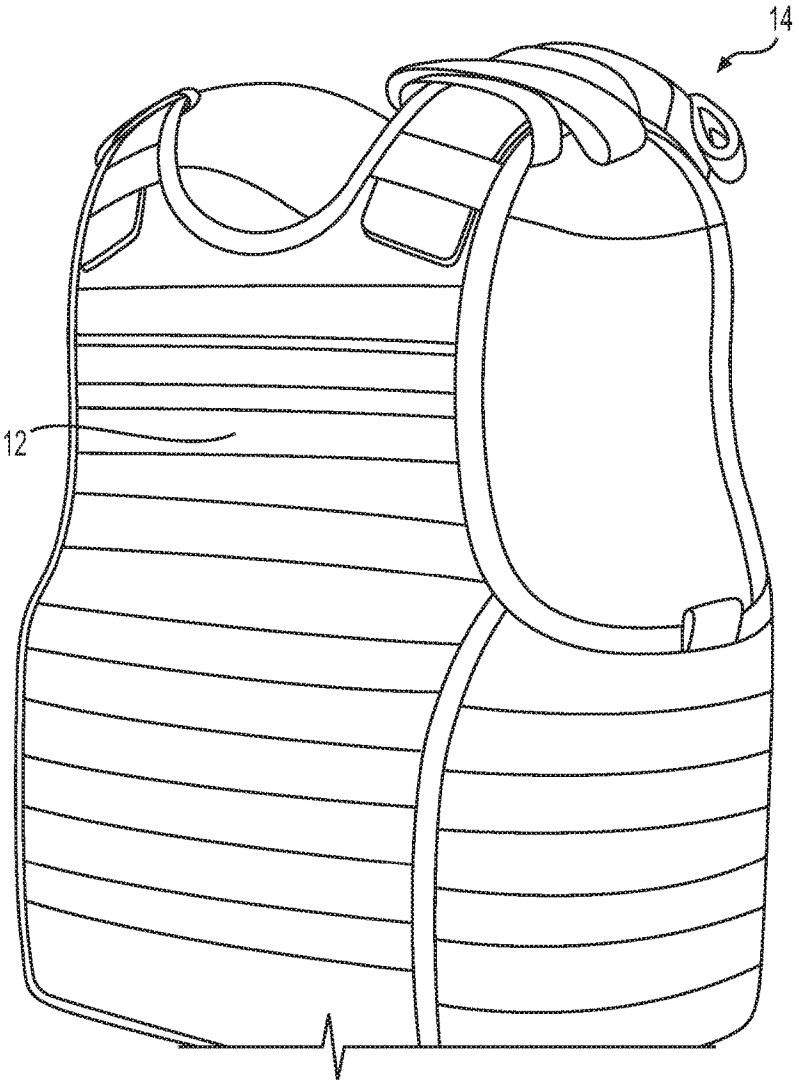
FIG. 6A shows an exemplary body mounting system such as a vest or body armor with mounting loops or webbing configured to receive a clip or loop structure used with one exemplary embodiment of the invention.

FIG. 6A shows an exemplary embodiment of body armor 14 with mounting structures (e.g. sewn loops) 12 configured to receive structural clips 11. In some embodiments, mounting structures 12 may include loops, webbing, hook and loop fasteners, or the like, configured to receive a clip or loop structure such as structural clips 11. In some embodiments, the structural clips 11 are flexible longitudinal structures that form loops configured to pass through a plurality of equipment mounting structures 12 on body armor 14.

Referring to FIG. 6B the structural clips 11 may be attached to mounting structures 12 found on body armor 14. Structural clips 11 may include a structural clip head 8 that is configured to be attached to mounting structure 11 by wrapping around the top end of one mounting structure 12. Structural clip 11 may be held in place by applying pressure at the structural clip head 8 so that the structural clip head 8 is configured to pinch in on the mounting structure. In some embodiments, structural clip 11 may attach to mounting structure 12 in such a manner that structural clip head 8 is configured to laterally receive mounting structure 12 so that the movement of structural clip 11 is fixed in a longitudinal direction, but free to move in a lateral direction.

Structural clip 11 may also include holes 16 designed to mate with fasteners attached to the to second support section 15. In some embodiments, there may be a plurality of holes 16 in structural clip 11, in other embodiments there may only be one hole 16, or no holes 16. In some embodiments, a slit 18 may be present at one end of structural clip 11. The slit 18 may be at the end of the structural clip 11 opposite of the structural clip head. In some embodiments, there may be at least one slit 18 in the structural clip 11, while in other embodiments, the slit 18 may not be included in structural clip 11. The slit 18 may interact with a protrusion found on structural clip head 8, in a manner so the protrusion goes through the slit 18 in order to for a loop with the structural clip 11.

Figure 7:
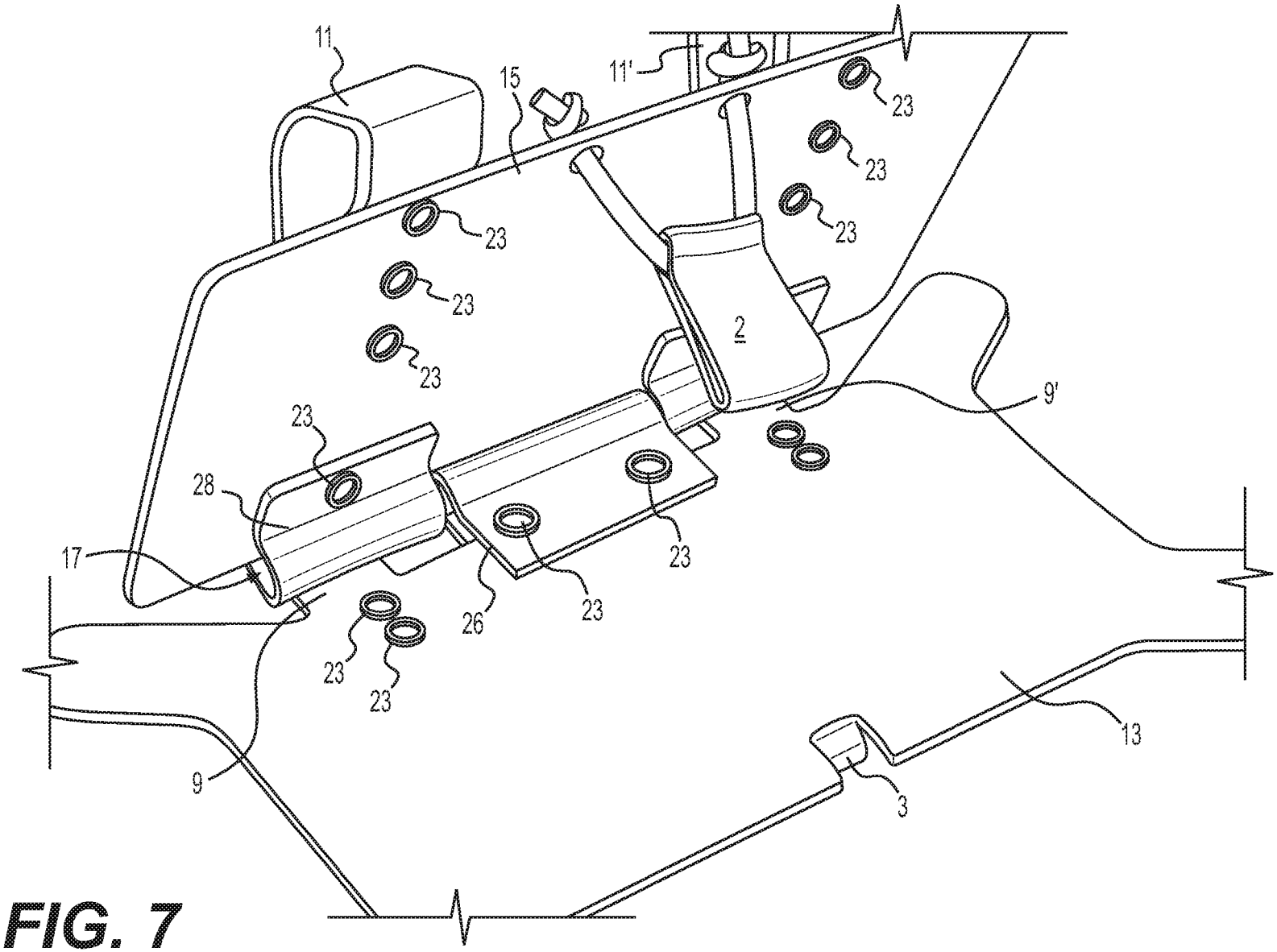
FIG. 7 shows a close-up perspective view of the exemplary body mounted ruggedized portable display device holder in an open position.

FIG. 7 shows a close-up perspective view of an exemplary body mounted ruggedized portable display device holder 1 in an open position. Fasteners 23 may be found on second support section 15 and device backing plate section 13 to couple various components. Fastener 23 may connect with structural clip 11. Fasteners 23 may be, snap fasteners, rivets, buttons, hook and loop fasteners, stitching, latch, buckle, strap, adhesive or other means of fastening. In some embodiments, fasteners 23 may be used to couple first support section 10 to mechanical stop 9. Fasteners 23 may couple second support section 15 to structural clips. Center hinge structure 26 and lateral hinge 28 may also be coupled to first support section 10 and/or second support section 15 by fasteners 23.

Figure 8:
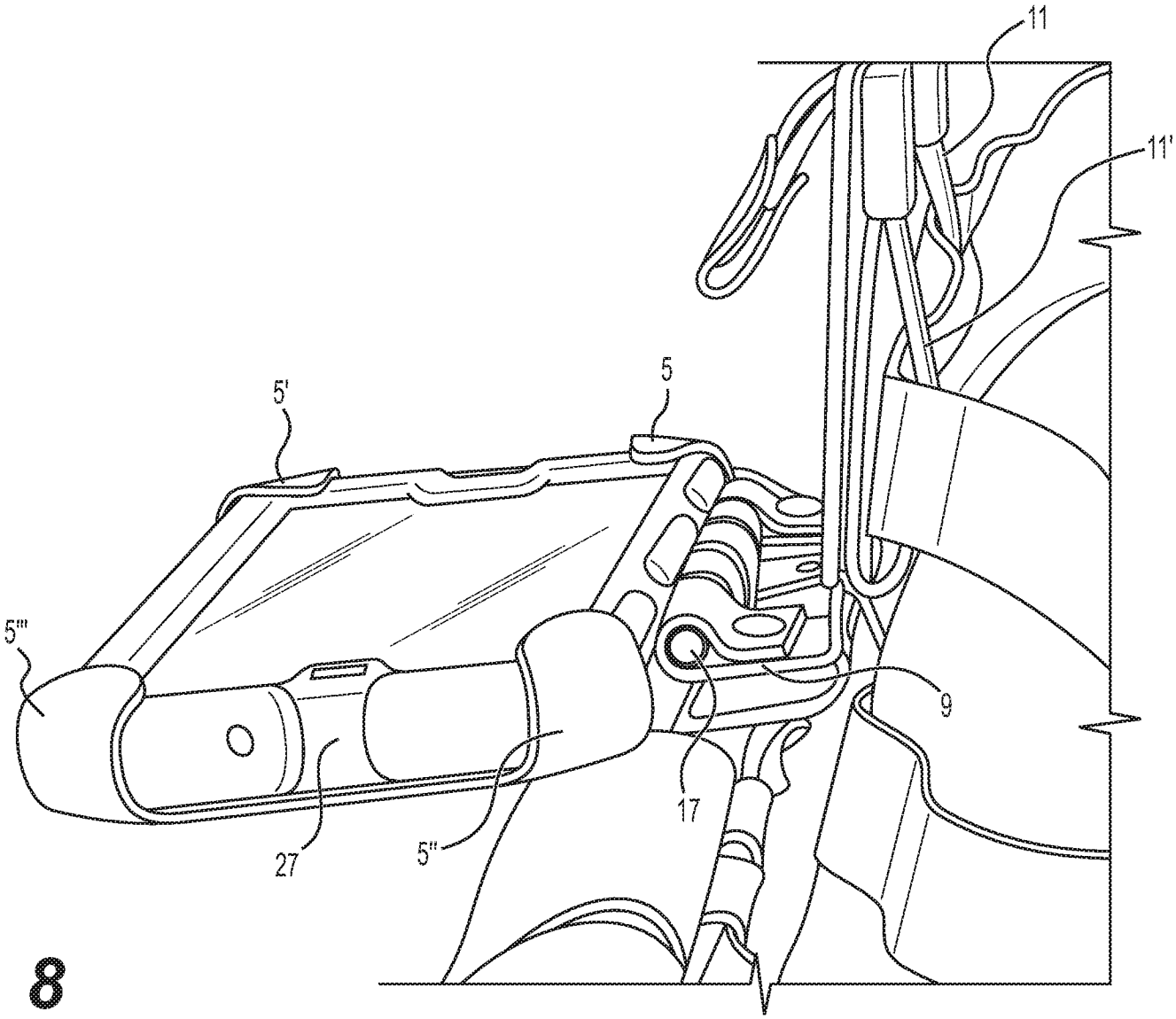
FIG. 8 shows a side view of an exemplary body mounted ruggedized portable display device holder in an open or viewing position with an exemplary display device supported by the holder.

FIG. 8 shows a side view of an exemplary body mounted ruggedized portable display device holder 1 in an open position with an exemplary display device 27 supported by the holder 1. In some embodiments, device clasp sections (5, 5', 5", 5") may be used to secure the display device 27 against the device backing plate section 13 so the display device 27 will not dislodge from body mounted ruggedized portable display device holder 1 when operator is in motion. Device clasp section (5, 5', 5", 5") may be physically manipulated by the operator to wrap around display device 27 such that one end of device clasp section (5, 5', 5", 5") will be disposed on a top side of display device while one other end of device clasp sections (5, 5', 5", 5") will be disposed on a bottom side of display device 27, where the bottom side is opposite the top side. In some embodiments, heat may be used to cause the device clasp sections (5, 5', 5", 5") material to become increasingly flexible so that an operator may physically manipulate device clasp section (5, 5', 5", 5") into the desired position. In other embodiments, device clasps 5 comprise of a flexible, semi-rigid material (e.g, bendable metal or a semi-rigid material that is metal fatigue resistant) such that a predetermined amount of force will be able to manipulate device clasp sections (5, 5', 5", 5"). Referring to FIG. 8, first support section 10 contains four device clasp sections (5, 5', 5", 5") disposed at each corner of device backing plate section 13 to support display device 27.

Figure 9:
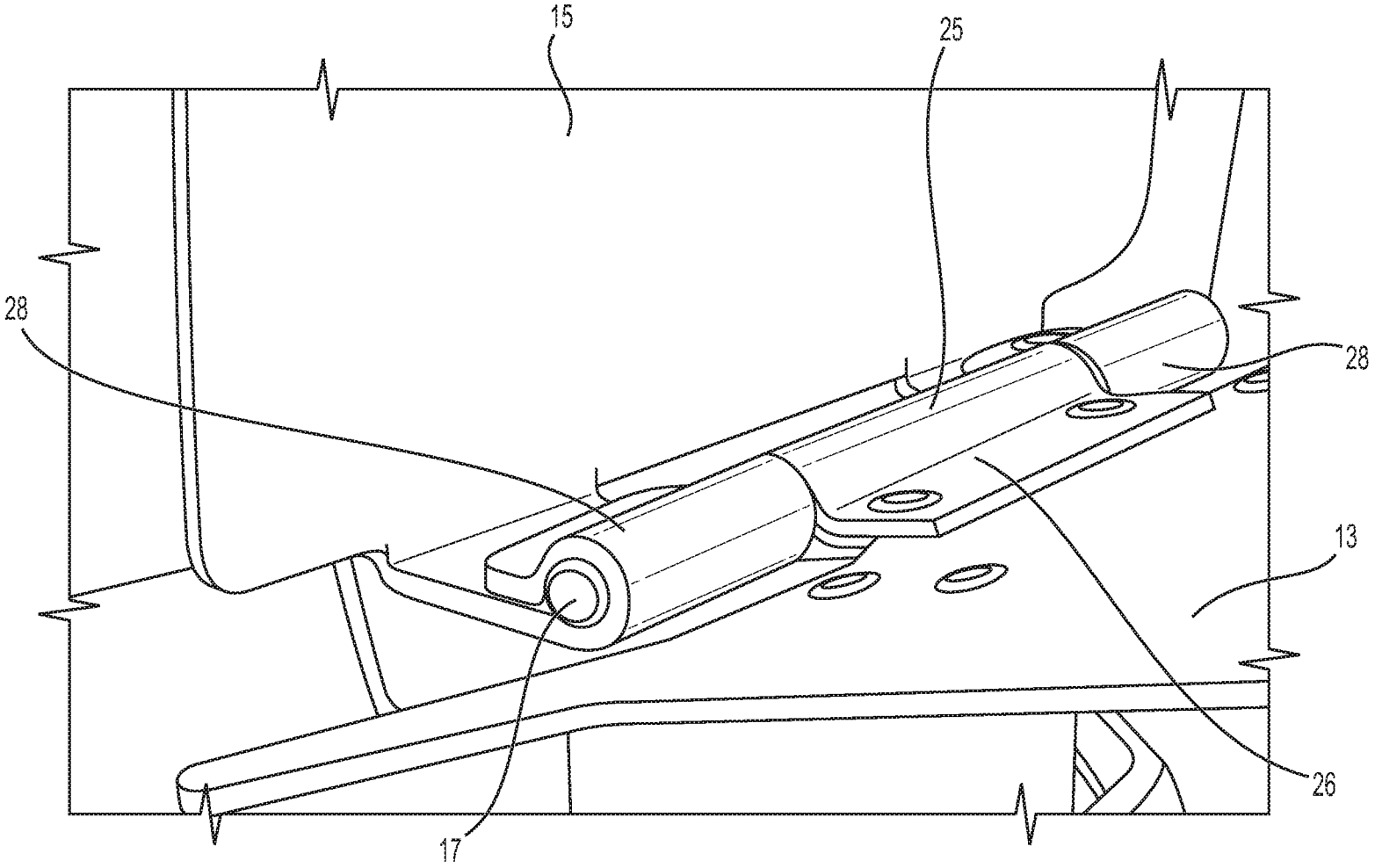
FIG. 9 shows a close-up view of a hinge assembly within a front perspective view of the body mounted ruggedized portable display device holder.

FIG. 9 shows a close-up view of a hinge assembly 25 within a front perspective view of the body mounted ruggedized portable display device holder 1. Hinge assembly 25 may include threaded rod 17, center hinge structure 26 and lateral hinges 28. Central hinge structure 26 may wrap around threaded rod 17 such that one end of central hinge structure 26 is disposed on top of one other end of central hinge structure 26 and coupled to first support section 10 using fasteners 23. Lateral hinges 28 may be configured in an equivalent manner. In some embodiments, central hinge structure 26 may be disposed between lateral hinges 28, such that the length of the center hinge structure 26 and lateral hinges 28 is substantially equal to the length of the threaded rod 17. Threaded rod 17 may be fixed in a lateral and longitudinal direction but be able to rotate with one degree of freedom, in along an axis parallel to threaded rod 17 and running laterally through the center of threaded rod 17. Central hinge structure 26 may be coupled to second support section 15 and be free to rotate relative to lateral hinges 28.

Second support section 15 may also include brackets that protrude from a bottom end of second support section 15. In some embodiments the brackets may be perpendicular with second support section 15 and protrude less than one inch. Other embodiments of second support section 15 include brackets that protrude greater than one inch and may form any angle with second support section 15 between 0° and 180°. In some embodiments, lateral hinges 28 may be disposed on the brackets found on second support section 15.

Figure 10:
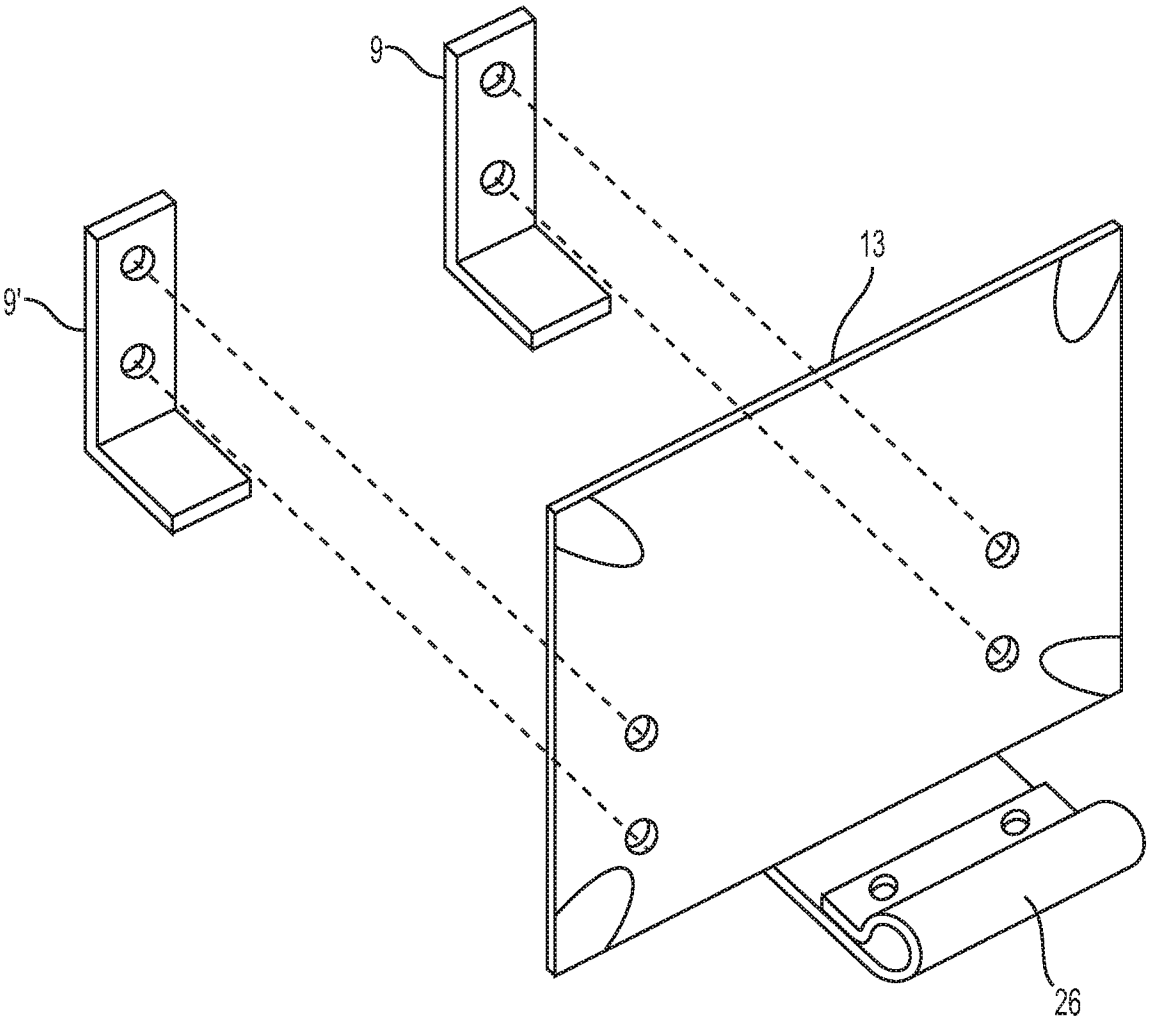
FIG. 10 shows an exploded diagram of an exemplary front section (e.g., first support section) with one hinge structures (center hinge structure) and mechanical stops which arrest rotation of the front plate away from a back plate of the exemplary holder to orient the display device in a particular orientation with regard to an operator.

FIG. 10 shows an exploded diagram of exemplary device backing plate section 13 with one of the hinge structures (center hinge structure 26) and mechanical stops 9 which arrest rotation of the first support section 10 away from the second support section 15. Mechanical stops 9 can restrict movement of the first support section 10 with respect to the second support section 15 and may prevent hinge assembly 25 from rotating past a predetermined angle. In some embodiments, the mechanical stops 9, 9' may be configured to prevent the first support section 10 from rotating to an angle further than 90° between first support section 10 and second support section 15. In other embodiments, mechanical stops may allow first support section 10 to rotate away from second support section 15 to form an angle greater than 90°.

Figure 11:
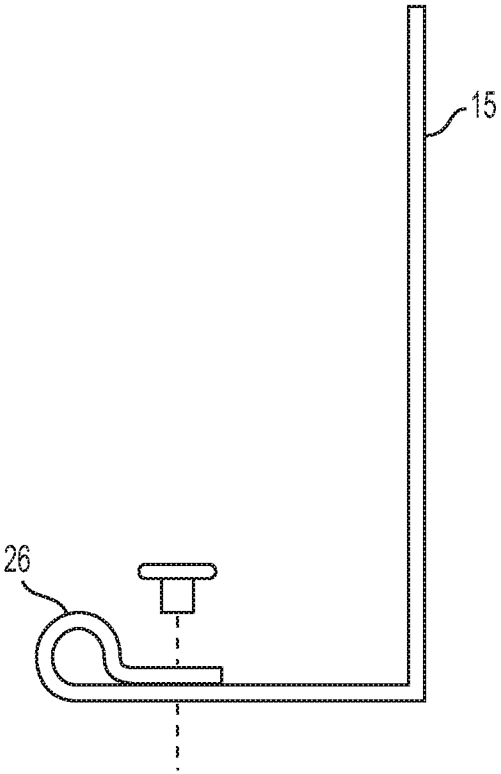
FIG. 11 shows a simplified side view of a drawing of an exemplary second support section showing one of two lateral hinges extending away from the exemplary second support section (e.g., portion that couples with an operator's vest, clothing, garment or body armor)

FIG. 11 shows a side view of a drawing of one embodiment showing one of two lateral hinges 26 extending away from the exemplary second support section 15. Threaded rod 17 may be inserted through the hole formed by lateral hinge 26. Lateral hinges can be molded to have a slight or predetermined partial interference fit with the threaded rod 17. For example, the hinges 26 can be thermoplastic material that can be heat shrunk around the threaded rod 17 to create a transition or slight interference fit by molding or shrinking the hinges 26 around the threaded rod 17.

Figure 12B:
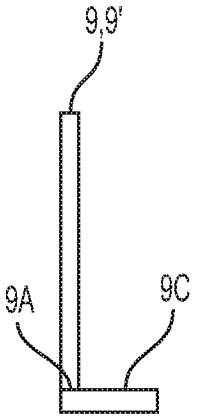
FIG. 12B shows a side view of the exemplary mechanical stop after it is formed with an angled section or bend point.
Figure 12A:
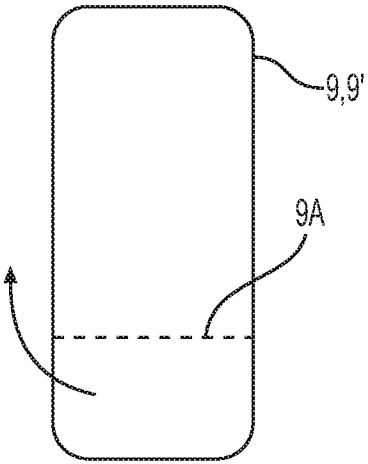
FIG. 12A shows a front view of an exemplary mechanical stop before it is formed with an angled section.

FIG. 12A shows a front view of an exemplary mechanical stop 9 before it is formed with an angled section. Mechanical stop 9 may be made from plastic, sheet metal, or other rigid material that may be bent without heavy machinery. Referring to FIG. 12B, a side view of the exemplary mechanical stop 9 after it is formed with an angled section or bend point is shown. In some embodiments, bend point may form a 90° angle, while in other embodiments, the angle formed at the bend point may be more than 90°.

Figure 13:
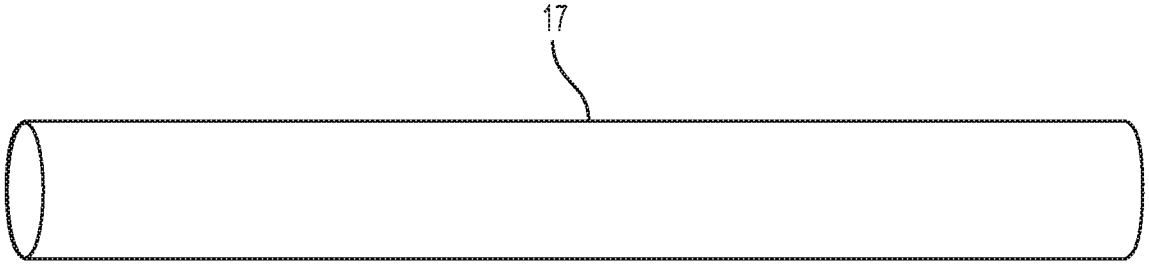
FIG. 13 show a simplified side view of an exemplary threaded rod or "all thread" rod without the threads used in an exemplary hinge.

FIG. 13 show a simplified side view of an exemplary threaded rod 17 or "all thread" rod without the threads. Threaded rod 17 may be cylindrical with a diameter of less than one inch. In some embodiments, the length of the threaded rod may be less than one foot. In some embodiments, the threaded rod 17 may be substantially equal to the length of display device 27.

Figure 14:
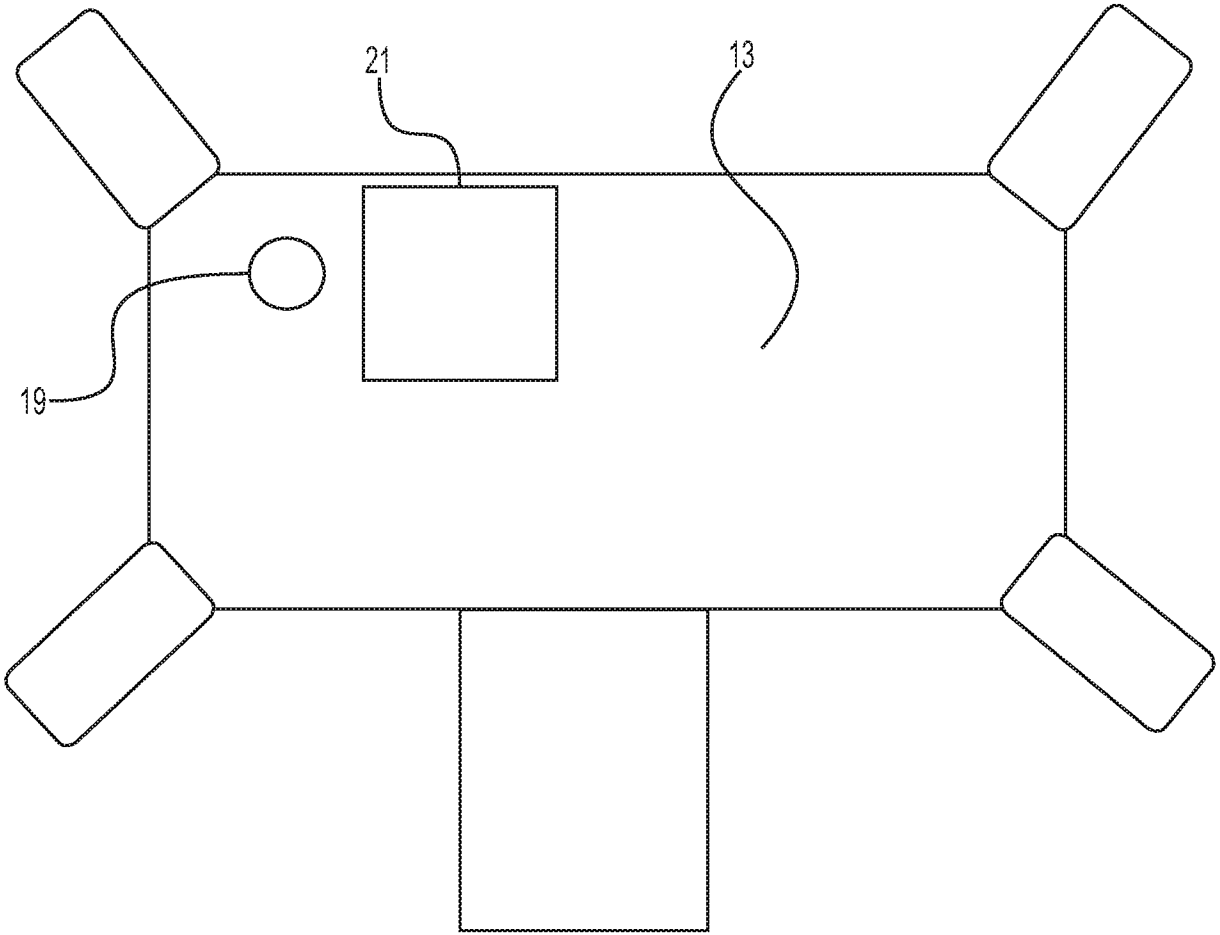
FIG. 14 shows a simplified plan view of exemplary alternative embodiment first support section with a camera hole and flexible cover (e.g. fabric sewn onto the cover to move over the camera hole that can include Velcro®) that covers the camera hole.

FIG. 14 shows a simplified plan view of exemplary alternative embodiment of first support section 10 with a camera hole 19 and flexible cover 21 that may be configured to cover camera hole 19. Camera hole 19 may be an aperture in device backing plate section 13 that is configured to overlie a camera found on display device 27 when inserted into body mounted ruggedized portable display device holder 1. In some embodiments, a flexible cover 21 may be attached to the front side of first support section 10, and configured to selectively cover the camera hole 19 to protect display device 27 camera from scratches or outside forces. In some embodiments, flexible cover may be permanently attached to first support section 10 at first end and selectively attached to first support section 10 at a second end, opposite the first end. The second end that is selectively coupled may be rotate about the first end to cover and uncover camera hole 19. The second end may be selectively coupled using adhesive, hook and loop fasteners, or any other manner known to selectively couple objects.

Figure 15:
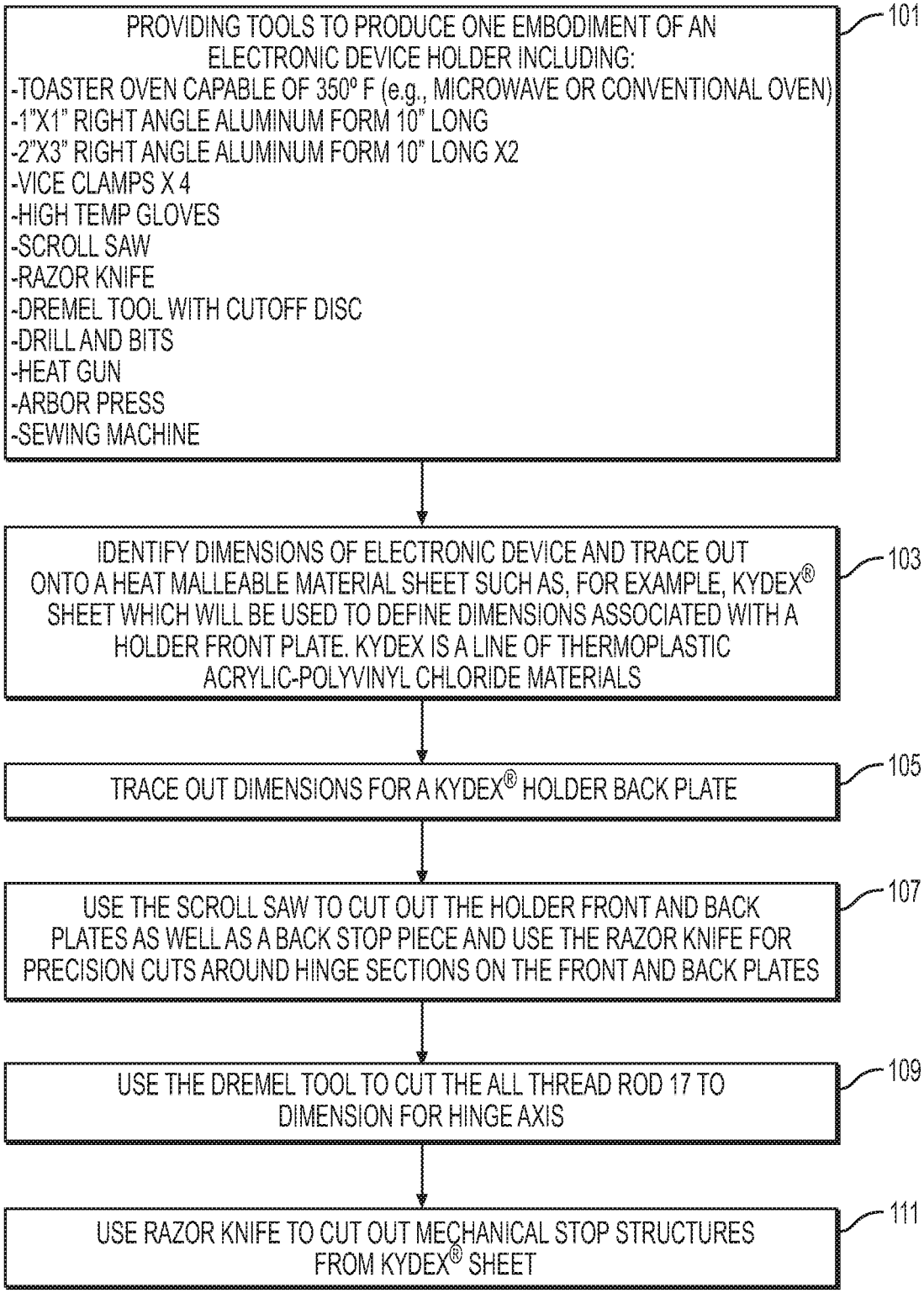
FIG. 15 shows a portion of an exemplary method in accordance with one embodiment of the invention.

Referring to FIG. 15, the present disclosure provides a portion of an exemplary method in accordance with one embodiment of the invention. At step 101 a heating source, capable of maintaining a 350° F. temperature, is provided. At step 103, an operator identifies desired dimensions of body mounted ruggedized portable display device holder 1 by adapting it to fit the particular display device 27 used by the operator. Dimensions are traced out onto a heat malleable material sheet, or thermoplastic material as discussed above, that will be used as the first support section 10. At step 105, The tracing process is performed again, using similar material, for the second support section 15. At step 107, a cutting instrument is used to cut out the first support section 10 and second support section 15 traces from the thermoplastic material. In some embodiment, the cutting instrument may be a saw (e.g., scroll saw), a razor, a knife, a sharpened object, or any other object to separate the thermoplastic material from itself. At step 109, a rotary tool (e.g., a Dremel tool with cutoff disc) may be used to cut the threaded rod 17 to a suitable dimension to be used with hinge assembly 25. At step 111, the cutting instrument may be used to create the mechanical stops 9 from the heat malleable material sheet or thermoplastic material.

Figure 16:
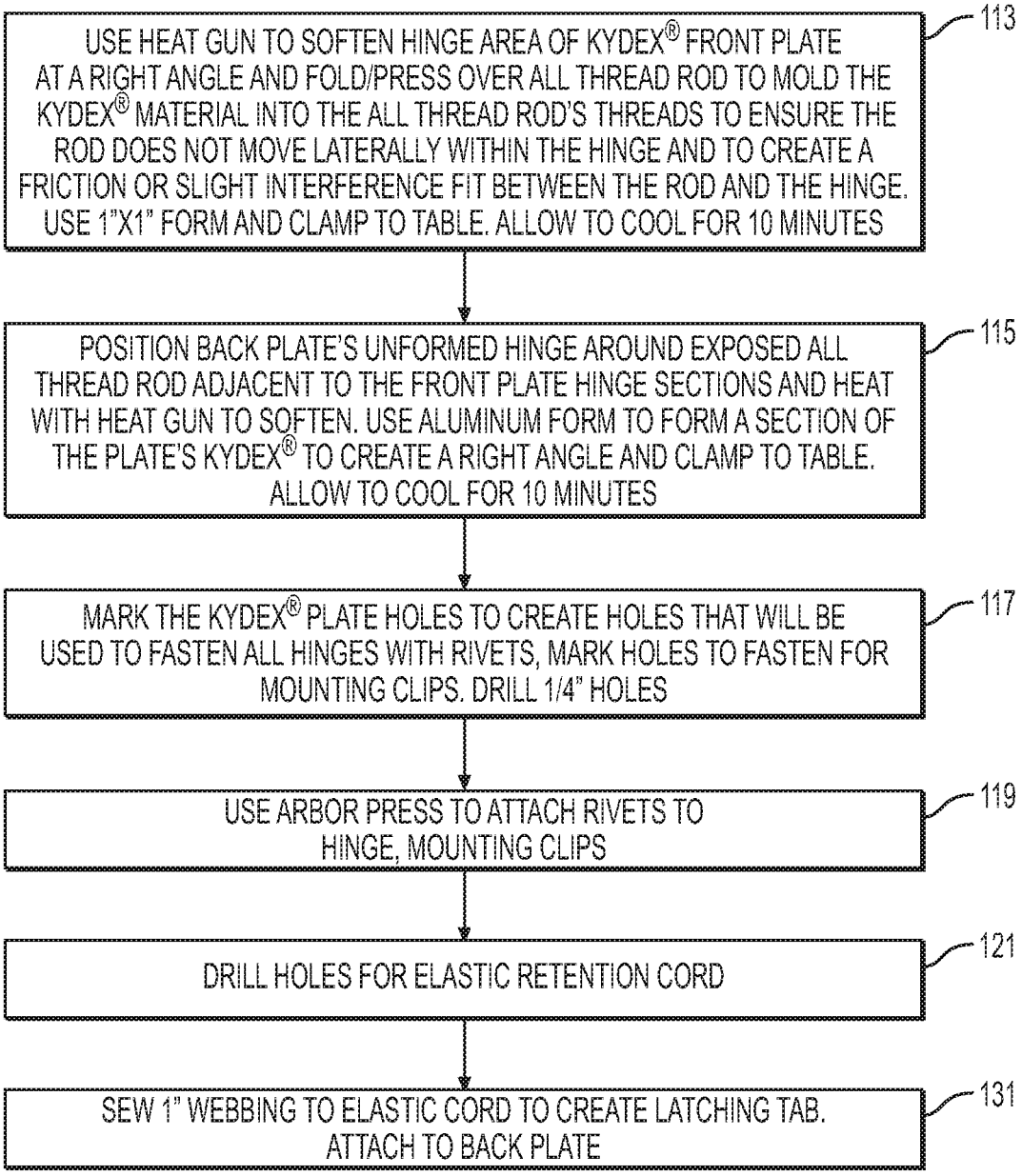
FIG. 16 show a continuation of the FIG. 15 exemplary method.

FIG. 16 show a continuation of the FIG. 15 exemplary method. At step 113, a heating source, for example a heat gun, is used to soften the thermoplastic material used for lateral hinges 28 to be folded over the threaded rod 17 to mold the thermoplastic material into the thread rod's 17 threads to ensure the rod does not move laterally within the hinge assembly 25 and to create a friction or slight interference or transition fit between the threaded rod 17 and the hinge assembly 25. In some embodiments, vice clamps or other clamping device may be used to maintain the shape of the molded thermoplastic material as it cools. At step 115, the heating source is used to soften the thermoplastic material used for central hinge structure 18 to be folded over the threaded rod 17 to mold the thermoplastic material into the thread rod's 17 threads to ensure the rod does not move laterally within the hinge assembly 25. In some embodiments, the heating source may also be used to heat second support section 15 to soften the thermoplastic to create the brackets that extrude perpendicularly from second support section 15. The formed lateral hinges 28 may be disposed on brackets and attached using fasteners 23. At step 117, holes may be marked into first support section 10 and second support section 10 and holes will be cut out at the marked positions to be used as fasteners 23. In one example, fasteners 23 may be rivets attached by an arbor press to structural clips 11, hinge assembly 25, mechanical stops 9, 9'. At step 121, holes may be drilled to attach the elastic band 4 element of the latch assembly 2. At step 131, the tab 6 may be attached to elastic band 4 which may in turn be attached to or through the drilled holes. In some embodiments, tab 6 is sewn to elastic band 4.

Figure 17:
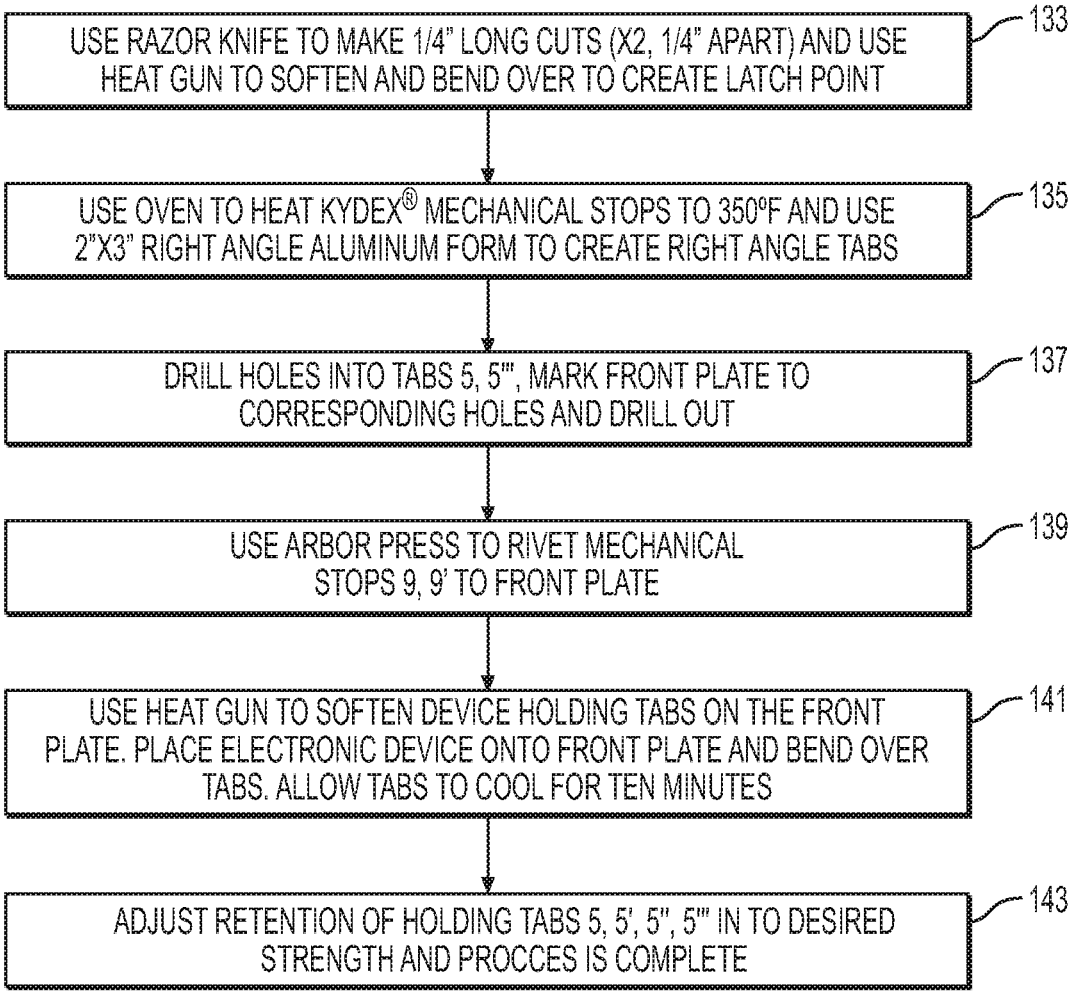
FIG. 17 shows a continuation of the FIGS. 15 and 16 exemplary method.

FIG. 17 shows a continuation of the FIGS. 15 and 16 exemplary method. At step 133, a cutting instrument may be used to cut out the notch 7 on first support section 10. In some embodiments, notch may be made by created by making two ¼" cuts that are ¼" apart then using the heat source to bend the cut-out section toward the front side of the first support section 10 to create hook 3. At step 135, mechanical stops 9,9' may be positioned adjacent to second support section 15 and heat with heating source to soften mechanical stops 9. The softened mechanical stops 9,9' are then molded to create a right-angle bend. In some embodiments, an aluminum form or cast is used to mold mechanical stops 9,9' to the desired configuration. In an exemplary embodiment, mechanical stops 9,9' are 2" by 3" right angles. In step 137, holes may be drilled into one or more device clasp sections (5, 5', 5", 5"). At step 139, mechanical stops 9,9' may be attached to first support section 10 by fasteners 23, e.g., riveting using an arbor press. At step 141, device clasp sections (5, 5', 5", 5") may be heated by heat source to soften thermoplastic material while display device 27 is disposed on first support section 10. Device clasp sections (5, 5', 5", 5") may then be bent over display device 27 to secure display device 27 to first support section 10. At step 143, device clasp sections (5, 5', 5", 5") may be adjusted for desired strength and support.

In an alternative embodiment further includes a water or moisture cover which is attached to one side of the first support section 10. Such a cover can include a structure which enables a user to roll up or extend the cover over the display device and the display device holder. The exemplary cover can further include a cover latching or retainer structure which latches the cover into place in an extended configuration.

Although the invention has been described in detail with reference to certain preferred embodiments, variations and modifications exist within the spirit and scope of the invention as described and defined in the following claims.

The invention claimed is:

1. A method of manufacturing portable display device holder comprising:

providing tools to produce one embodiment of an electronic device holder including a heating structure that outputs heat of at least 350 Degrees F., at least one form, a molding cast, vice clamps, a scroll saw, a razor knife, a rotating cutting tool with cutoff disc, a marking tool, a measurement structure, a drill and at least one drill bit, a heat gun, an arbor press, and a sewing kit;

measuring, using the measurement structure, and determining a first shape within a two dimensional plane of a display device that is parallel to a side of the portable display device;

placing a first visible cutting path or markings, using the marking tool, onto a first heat malleable material sheet section that corresponds to portions of the first shape to define an outline of a holder front plate that includes a first hinge side which extends beyond a portion of the first shape;

placing a second visible cutting path or markings onto a second heat malleable material sheet section that corresponds to portions of the first shape to define an outline of a holder back plate that includes a second hinge side which extends beyond a portion of the first shape;

cutting, using the scroll saw, the first and second heat malleable material sheet to produce the front and back plates respectively defined by the first and second visible cutting path;

cutting or forming, using the razor knife, a first hinge section in the first hinge side and a second and third hinge section in the second hinge side, wherein the second and third hinge sections are formed in the second hinge side so that the third hinge section extends between the second and third hinge sections when remaining outer edges of the first and second hinge sides as well as adjacent sides of the front plate and second plate are aligned;

cutting, using the circular cutting tool, the all thread rod a first length no longer than the first or second hinge sides of the first and second plates;

measuring and cutting out, using the measurement structure and razor knife, a first and second rotation stop structures from heat malleable material sheet in a rectangular shape;

heating and softening, using the heat gun, the first hinge section of the front plate;

clamping the front plate to the at least one form or the molding cast using vice clamps;

pressing and wrapping the heated first hinge section around the all thread rod to a slight interference fit such that the all thread rod does not move laterally within the first hinge section and to create a rotational friction or slight interference fit between the rod and the first hinge section;

heating and softening, using the heat gun, the second and third hinge sections of the back plate;

clamping the back plate to the at least one form or the molding cast using vice clamps;

pressing the second and third hinge sections around the all thread rod to a slight interference fit such that the all thread rod does not move laterally within the second and third hinge sections and creates a rotational friction or slight interference fit between the all thread rod and the second and third hinge sections, wherein the first hinge section is positioned or disposed onto the all threat rod between the second and third hinge sections when the remaining outer edges of the first and second hinge sides as well as adjacent sides of the front plate and second plate are aligned;

drilling a first set of holes, using the drill, in the front plate and first hinge section;

drilling a second and third set of holes, using the drill, respectively through the back plate and the second and third hinge sections;

providing a first and second mounting clips each formed in a rectilinear shape with a first width and having at least one mounting clip hole through each clip;

attaching a rivet, using the arbor press, respectively through the first set of drilled holes to couple the first hinge section to the front plate;

attaching a rivet respectively through the second and third sets of drilled holes as well as a respective mounting clip hole so as to couple one of said mounting claims to the back plate;

forming a latch assembly by sewing a latching tab formed from webbing or a textile section to a center section of an elastic cord;

attaching terminal ends of the latch assembly's elastic cord to spaced apart and centered sections of a side of the back plate opposing the second and third hinge sections;

cutting a section of the and use heat gun to soften and bend over to create latch point in a centered section of a side of the front plate opposing the first hinge section;

heating at least a portion of the mechanical stops and using a right angle form to create right angle sections of the mechanical stops;

riveting, using the arbor press, the mechanical stops to a portion of the front plate on opposing sides of the first hinge section;

drilling a hole through one of the plates corresponding to a field of view of a camera optic formed into an electronic device with a shape corresponding to the holder heating at least portions of a plurality of protrusions to soften the plurality of protrusions; and positioning the electronic device onto front plate and bending the plurality of protrusions to respectively form them around sides and adjacent edges of the electronic device to secure the electronic device to the front plate.

* * * * *